US010248080B2

(12) United States Patent
Fujii

(10) Patent No.: US 10,248,080 B2
(45) Date of Patent: Apr. 2, 2019

(54) IMAGE FORMING APPARATUS INCLUDING VORTEX TUBE THAT GENERATES COLD AIR TO COOL A RECORDING MEDIUM AND WARM AIR TO HEAT A MEMBER INSIDE THE IMAGE FORMING APAPRATUS

(71) Applicant: CANON KABUSHIKI KAISHA, Tokyo (JP)

(72) Inventor: Masahiko Fujii, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/974,879

(22) Filed: May 9, 2018

(65) Prior Publication Data

US 2018/0329364 A1 Nov. 15, 2018

(30) Foreign Application Priority Data

May 12, 2017 (JP) ..... 2017-095443

(51) Int. Cl.
*G03G 15/00* (2006.01)
*G03G 21/20* (2006.01)
*G03G 15/20* (2006.01)

(52) U.S. Cl.
CPC ..... *G03G 21/206* (2013.01); *G03G 15/2017* (2013.01); *G03G 15/2064* (2013.01); *G03G 21/203* (2013.01); *G03G 2221/1645* (2013.01)

(58) Field of Classification Search
CPC .. G03G 15/2017; G03G 21/20; G03G 21/203; G03G 21/206
USPC ..... 399/92, 341
See application file for complete search history.

(56) References Cited

U.S. PATENT DOCUMENTS

| | | | | |
|---|---|---|---|---|
| 4,727,385 A * | 2/1988 | Nishikawa et al. | . | G03G 21/206 346/146 |
| 8,509,664 B2 * | 8/2013 | Hasegawa et al. | .. | G03G 21/203 399/323 |
| 8,660,456 B2 * | 2/2014 | Nishino et al. | ..... | G03G 21/206 399/92 |
| 9,946,223 B2 * | 4/2018 | Kojima et al. | ..... | G03G 21/206 |

FOREIGN PATENT DOCUMENTS

| | | |
|---|---|---|
| JP | 2007-233327 A | 9/2007 |
| JP | 2016-053609 A | 4/2016 |

* cited by examiner

*Primary Examiner* — William J Royer
(74) *Attorney, Agent, or Firm* — Venable LLP

(57) ABSTRACT

An image forming apparatus includes an image forming section configured to form a toner image, a transfer portion configured to transfer the toner image onto a recording medium, and a fixing portion configured to fix the toner image on the recording medium, by heating the toner image. A vortex tube is configured to receive supply of compressed air generated by a compressor to generate cold air having a temperature that is less than a temperature of the compressed air, and warm air having a temperature that is greater than the temperature of the compressed air. A cooling portion is configured to receive a supply of the cold air generated by the vortex to cool the recording medium on which the toner image has been fixed by the fixing portion. Further, a member inside of the image forming apparatus is heated by the warm air generated by the vortex tube.

16 Claims, 9 Drawing Sheets

IMAGE FORMING APPARATUS INCLUDING VORTEX TUBE THAT GENERATES COLD AIR TO COOL A RECORDING MEDIUM AND WARM AIR TO HEAT A MEMBER INSIDE THE IMAGE FORMING APAPRATUS

This application claims the benefit of Japanese Patent Application No. 2017-095443, filed May 12, 2017, which is hereby incorporated by reference herein in its entirety.

BACKGROUND OF THE INVENTION

Field of the Invention

The present invention relates to an image forming apparatus configured to form an image on a sheet.

Description of the Related Art

An image forming apparatus using a method of fixing a toner image transferred onto a sheet in a heating-type fixing device is known. In the above-mentioned image forming apparatus, however, a temperature of the sheet rises due to the heating during the fixing process. The rise in temperature of the sheet to a temperature equal to or greater than a given temperature may cause firm adhesion between toner particles or between toner and the sheet when the sheet is stacked in a sheet delivery tray, causing so-called "adhesion of delivered sheets," which becomes a cause of an image defect. Therefore, before being stacked in the sheet delivery tray, the sheet having the toner image fixed thereon is required to be cooled by using an air-cooling fan, to cool the sheet to a temperature that does not cause the adhesion of delivered sheets.

In recent years, there has been a tendency to decrease a melting point of toner. Therefore, the temperature that causes the adhesion of delivered sheets is decreased. Further, a conveyance speed is increased because of improvement in image formation process speed. Under the influence of the facts described above, it becomes difficult to cool the sheet to the temperature that does not cause the adhesion of delivered sheets. As a result, the image defect caused by the adhesion of delivered sheets further hinders improvement in image formation speed. For example, in Japanese Patent Application Laid-Open No. 2016-53609, there is disclosed a configuration in which a delivered sheet cooling unit varies an airflow rate of a cooling fan, which is configured to take in outside air, depending on a paper sheet size.

With the related art method of taking in and cooling the outside air by the cooling fan, it may be sometimes difficult to suppress the occurrence of the adhesion of delivered sheets even with an increase in airflow rate. For example, under a high-temperature environment at an outside-air temperature exceeding 30° C., or when an attempt is made to enhance productivity by increasing an operation speed of the image forming apparatus, it becomes difficult to suppress the occurrence of the adhesion of delivered sheets. Further, not only the sheet after the fixing but also a heat-generating portion, such as an electrical component is required to be cooled in some cases.

SUMMARY OF THE INVENTION

According to one embodiment, the present invention provides an image forming apparatus including an image forming section configured to form a toner image, a transfer portion configured to transfer the toner image formed by the image forming section onto a recording medium, a fixing portion configured to fix the toner image, which is transferred by the transfer portion, on the recording medium, by heating the toner image, a vortex tube that is configured to a receive supply of a compressed air generated by a compressor to generate cold air having a temperature that is less than a temperature of the compressed air, and warm air having a temperature that is greater than the temperature of the compressed air, and a cooling portion, that is configured to receive supply of the cold air generated by the vortex tube to cool the recording medium on which the toner image has been fixed by the fixing portion, wherein a member inside the image forming apparatus is heated by the warm air generated by the vortex tube.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
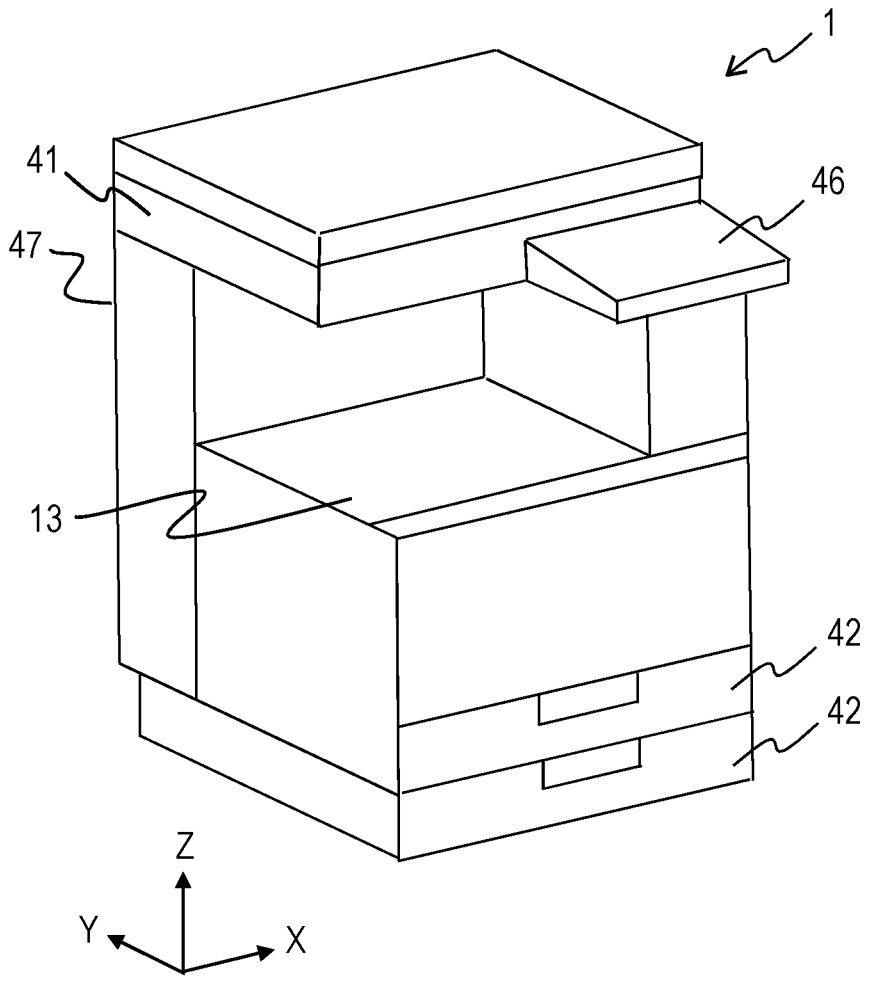
FIG. 1 is an external appearance perspective view of an image forming apparatus according to an embodiment of the present invention.
Figure 2:
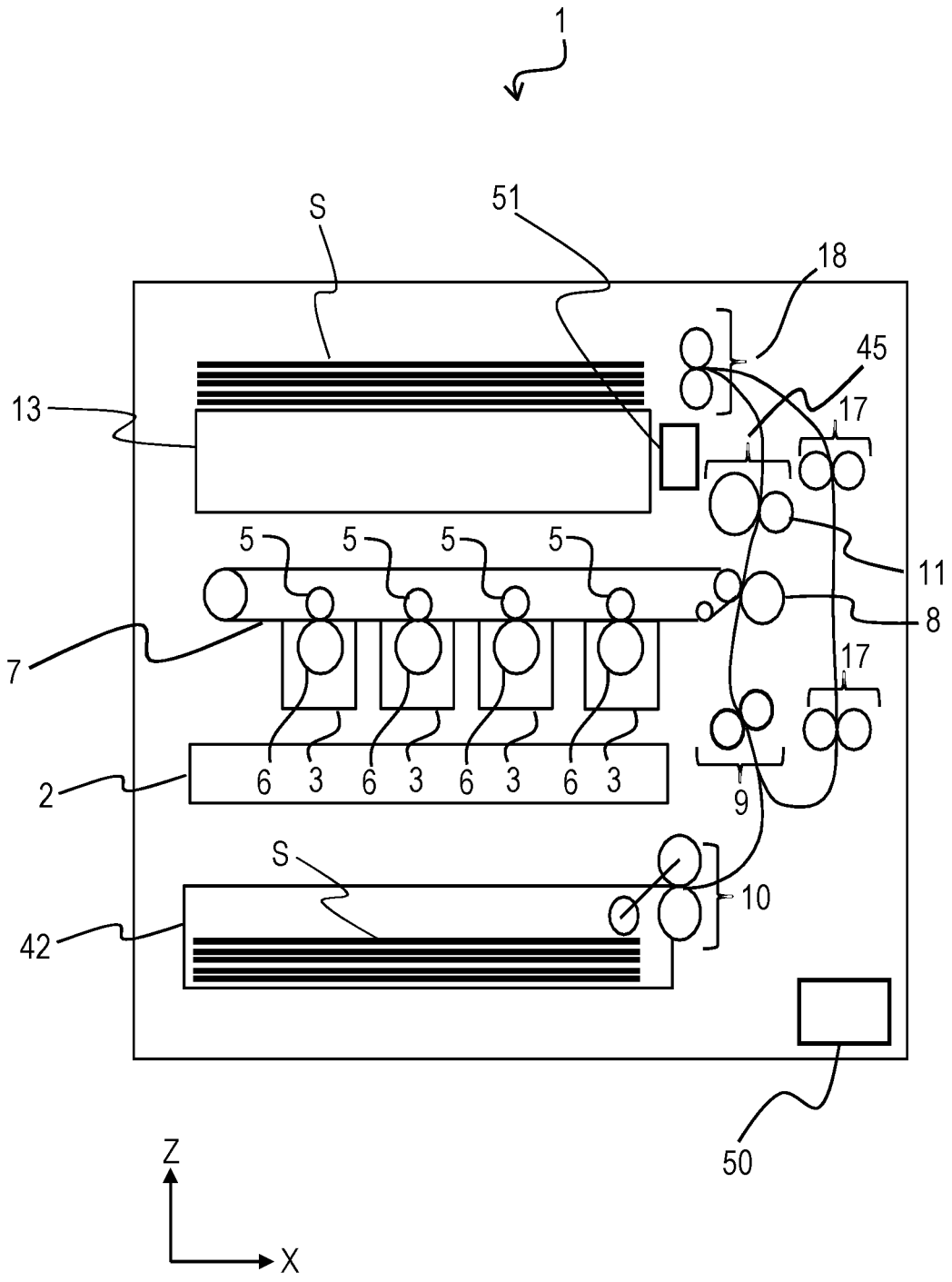
FIG. 2 is a sectional view of the image forming apparatus according to the embodiment of the present invention.

Now, an image forming apparatus 1 according to an embodiment of the present invention is described with reference to the drawings. FIG. 1 is a perspective view for illustrating an external appearance of the image forming apparatus 1 according to the embodiment of the present invention, and FIG. 2 is a sectional view of a main body part of the image forming apparatus 1. As illustrated in FIG. 1, the image forming apparatus 1 includes a delivery tray 13, an original reading section 41, sheet feeding sections 42, an operation section 46, and an electrical-circuit mounted section 47. Further, the image forming apparatus 1 includes an image forming section, a fixing portion 45, and a sheet conveying section inside the main body.

More specifically, as illustrated in FIG. 2, which is the sectional view of the image forming apparatus, the main body (image forming section) of the image forming apparatus 1 includes an exposure unit 2, image forming units 3, primary transfer units 5, photosensitive drums 6, and an intermediate transfer belt 7. The image forming section includes four photosensitive drums 6 to form toner images in four colors. Each of the image forming units 3, as a process cartridge, includes a charger, a developing device, and a cleaner (all not shown) arranged around a corresponding one of the photosensitive drums 6. In an upper part of the image forming section, the intermediate transfer belt 7, serving as an intermediate transfer unit, is arranged so as to be held in contact with the photosensitive drums 6.

The photosensitive drums 6 are charged by the chargers (not shown), respectively, and are then exposed to light by the exposure unit 2 to form electrostatic latent images on the photosensitive drums 6, respectively. The electrostatic latent images are developed by the developing devices (not shown) to form toner images on the photosensitive drums 6, respectively. Along with rotation of the photosensitive drums 6, the toner images reach the primary transfer units 5 with which the photosensitive drums 6 and the intermediate transfer belt 7 come into contact, respectively. Primary transfer biases are applied from an electrical circuit (not shown) to the primary transfer units 5, respectively. As a result, the toner images are sequentially transferred from each of the photosensitive drums 6 onto the intermediate transfer belt 7.

Sheets S, as recording materials that being recording media which are stored in the sheet feeding section 42 (storage section), are taken out by a pickup roller and fed, one by one through intermediation of separation rollers 10. Timing to start conveyance of a fed sheet S is adjusted by registration rollers 9. After that, the sheet S is conveyed to a nip portion (transfer portion) formed by a secondary transfer roller 8 and the intermediate transfer belt 7, and then, the toner images on the intermediate transfer belt 7 are secondarily transferred onto the sheet S.

The sheet S onto which the toner images have been transferred is conveyed to the fixing portion 45. At the fixing portion 45, the sheet S receives heat and pressure by a fixing roller 11 to melt and to mix the toners, and then, to fix an image onto the sheet S. The sheet S, on which the printed image has been formed, is delivered to the delivery tray 13 by a delivery conveyance portion 18 provided downstream of the fixing portion 45, and is then stacked therein. For carrying out double-sided printing, the sheet S is conveyed by reverse conveyance rollers 17 to the secondary transfer portion. After completion of the double-sided printing, the sheet S is conveyed to the fixing portion 45, and is then delivered to the delivery tray 13 serving as a stacking section by the delivery conveyance portion 18.

Cold Air and Warm Air Supply System

Figure 3:
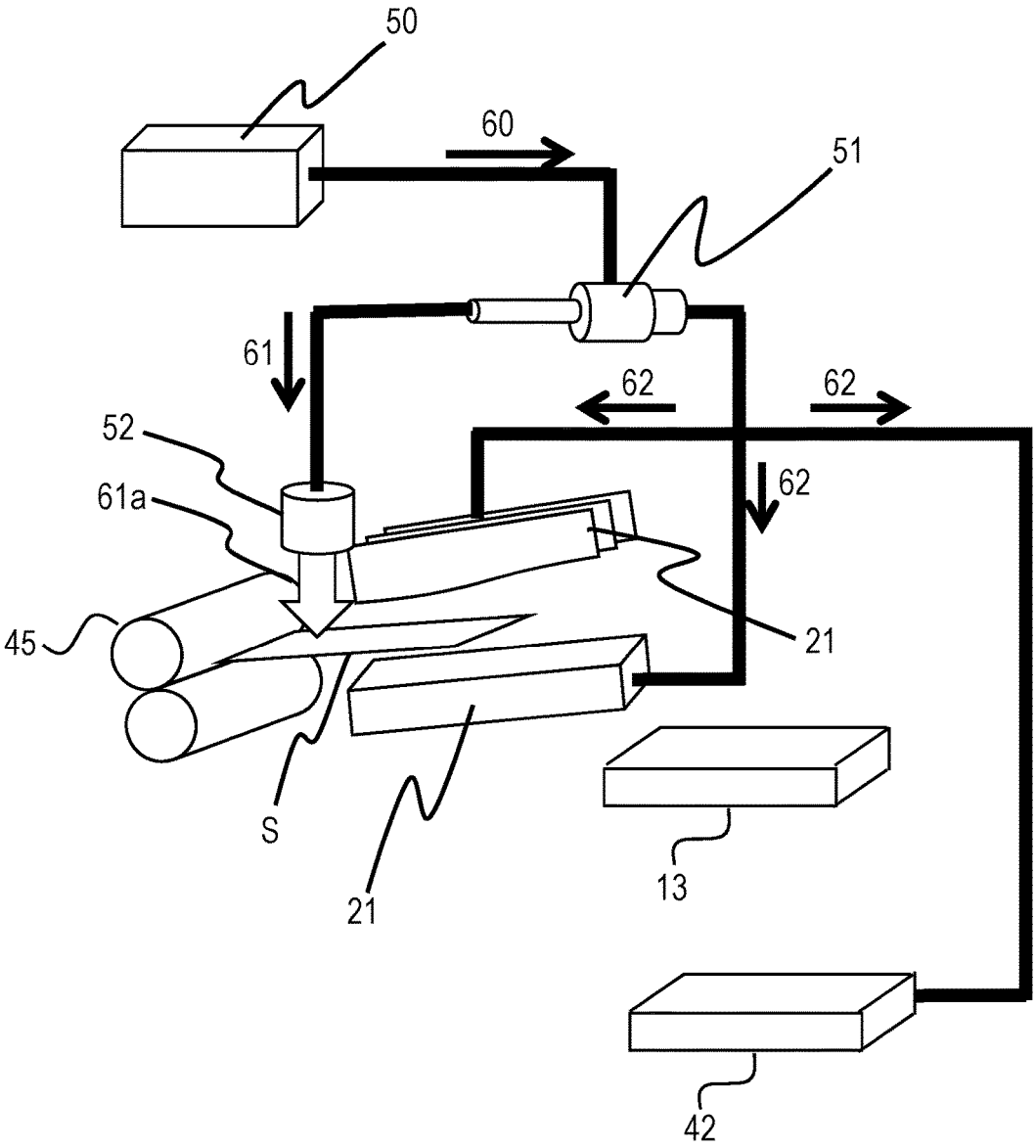
FIG. 3 is an illustration of a configuration example of a system in the embodiment of the present invention.

The image forming apparatus 1 of this embodiment includes a vortex tube 51. The vortex tube 51 cools and heats a predetermined portion of the image forming apparatus 1. FIG. 3 is an illustration of an example of a schematic configuration of the system.

In a casing of the image forming apparatus 1, there are provided the vortex tube 51 and a compressor 50. A pipe is laid between the vortex tube 51 and the compressor 50, so that compressed air 60 can be supplied from the compressor 50 to the vortex tube 51. After the compressed air 60 is input to the vortex tube 51 from the compressor 50, the vortex tube 51 uses an eddy current, compression, expansion, and a pressure difference inside of the vortex tube 51 to split the compressed air into cold air and warm air under a vortex effect, and hence, the cold air and the warm air can be supplied to an outside area at the same time. In the following description, the term "cold air" refers to air having a temperature that is less than that of the input compressed air, whereas the term "warm air" refers to air having a temperature that is greater than that of the input compressed air.

The image forming apparatus 1 of this embodiment uses the vortex tube 51 that is capable of supplying the cold air and the warm air at the same time, and, more specifically, to supply cold air 61 and warm air 62 to an appropriate portion inside the image forming apparatus 1 to perform cooling and heating. Specifically, in this embodiment, the sheet S, having a high temperature after having been subjected to the fixing process by the fixing portion 45, is cooled with use of the cold air 61 supplied from the vortex tube 51 before reaching the delivery tray 13. At this time, a temperature of the cold air 61 supplied from the vortex tube 51 is controlled not to be 0 degree Celsius or less so as not to form ice in a periphery of a pipe for the cold air 61.

In this embodiment, the warm air 62 supplied from the vortex tube 51 is used for heating to prevent dew condensation on sheet delivery guides 21 (conveyance guides), or to dehumidify the sheets S stored in the sheet feeding section 42. When the dew condensation is less liable to occur, or the dehumidification of the sheets S is not required, a mechanism for changing a flow passage for the warm air 62 is provided so that the warm air 62 can be discharged to an area outside of the image forming apparatus 1.

The vortex tube 51 can be provided in the vicinity of the delivery conveyance portion 18 inside the image forming apparatus 1 so as to reduce a length of the pipe for the cold air 61. The vortex tube 51 may, however, be provided in a suitable space inside the casing so that the cold air 61 is guided to the delivery conveyance portion 18 by a pipe. The reason is as follows. It is desired that the temperature of the cold air 61 for cooling the sheets S not be less than the freezing point. Therefore, in contrast to a case in which strong cooling to a temperature less than the freezing point is intended for use, a certain degree of increase in length of the pipe for the cold air 61 is allowable. The pipe for the cold air 61 may be branched so as to be used to cool an electrical component being a heat-generating portion, such as a circuit board provided in the electrical-circuit mounted section 47, a power supply, or a drive motor.

Temperature sensors may be provided in the vicinity of a cold-air outlet port and in the vicinity of a warm-air outlet port of the vortex tube 51, so that a controller may regulate the temperature of the cold air 61 or a temperature of the warm air 62 as needed while monitoring the temperature of the cold air 61 and the temperature of the warm air 62. At this time, the control section may control drive of the compressor 50 or a regulation valve for the vortex tube 51. A unit that is configured to monitor a temperature may be arranged in each portion inside the image forming apparatus 1 to input temperature information to the control section, and hence the control section can detect excess and deficiency of the cold air 61 or the warm air 62 to control the drive of the compressor 50, opening and closing of a flow valve for the cold air 61 or the warm air 62, or a flow switching valve.

The compressor 50 is provided, for example, in the vicinity of a bottom portion inside the image forming apparatus 1. In order to reduce noise of the image forming apparatus 1, leakage of operation noise can be suppressed by installing the compressor 50 in a region surrounded by an exterior cover. In some cases, a cover having high noise insulation performance may be provided around the compressor 50, or an acoustic absorbing material or a vibration insulating material may be arranged.

Figure 9:
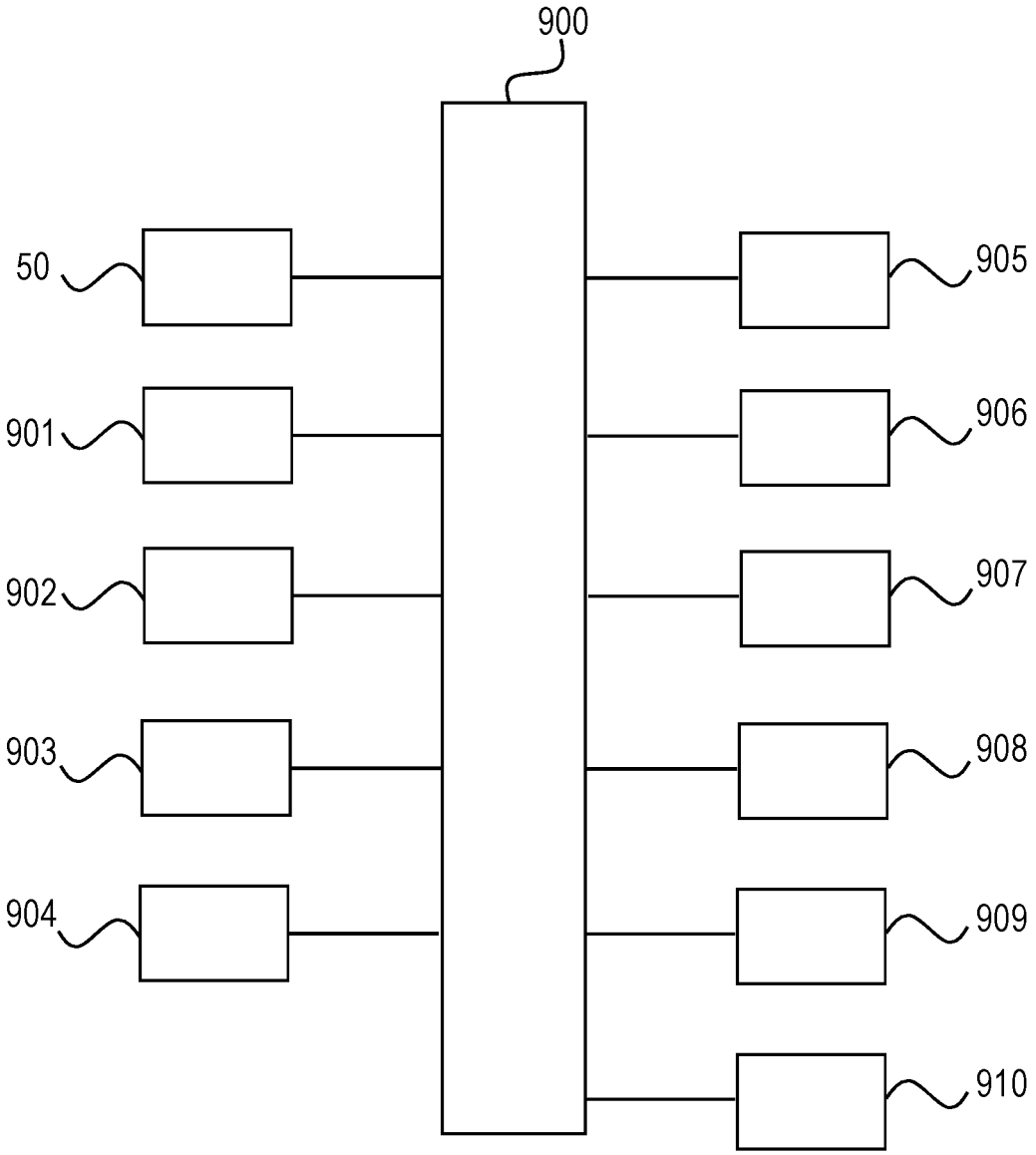
FIG. 9 is a control block diagram in the embodiment of the present invention.

FIG. 9 is a block diagram for illustrating an example of the system configured to control the supply of the cold air and the warm air. A control section 900 includes a central processing unit (CPU). The compressor 50 is provided inside the image forming apparatus 1. An output regulating valve 901 is provided in the vortex tube 51. A flow switching valve 902 and a flowrate control valve 903 are provided to the pipe for the cold air 61. A flow switching valve 904 and a flowrate control valve 905 are provided to the pipe for the warm air 62. A temperature sensor 906 measures a temperature of an apparatus environment, and a humidity sensor 907 measures a humidity of the apparatus environment. A temperature sensor 910 measures a temperature of the electrical circuit mounted portion 47, a temperature sensor 908 measures a temperature of the sheet feeding section 42, and a temperature sensor 909 measures temperatures of the sheet delivery guides 21.

The control section 900 controls the compressor 50 and the output regulating valve 901 provided inside the vortex tube 51 based on information input from the temperature sensors 906, 908, 909, and 910 and the humidity sensor 907 to control the amount of supply and the temperature of the cold air 61 and the amount of supply and the temperature of the warm air 62. At the same time, the control section 900 controls the flow switching valves 902 and 904 and the flowrate control valves 903 and 905 to supply the cold air 61 and the warm air 62 to a required portion in necessary amounts, or to discharge a surplus of warm air to an area outside of the apparatus 1. A configuration of the sensors and the control elements is not limited to the example of the block diagram of FIG. 9, and can be appropriately changed.

Cooling Mechanism

A cooling mechanism included in the image forming apparatus 1 of this embodiment is described. As illustrated in FIG. 3, the compressor 50 generates the compressed air 60 and supplies the generated compressed air 60 to the vortex tube 51 through the pipe. The cold air 61 supplied from the vortex tube 51 is blown out from an outlet port 52 to the sheet S having a high temperature delivered from the fixing portion 45. Specifically, in a cooling portion between the fixing portion 45 and the delivery tray 13, a cooling blow 61*a*, which is an airflow having a low temperature, is jetted against the sheet S having a high temperature to cool the sheet S.

Through cooling of the sheet S delivered from the fixing portion 45, the toners can be firmly fixed onto the sheet S. At the same time, an image defect caused by adhesion of delivered sheet S on the sheet S stacked in the delivery tray 13 can be prevented.

Further, through intermediate cooling of the sheet S delivered from the fixing portion 45, the amount of curl of the sheet S can be reduced. Therefore, problems in conveyance, such as damage of the sheet S caused by the sheet S being caught on the sheet delivery guides 21, can be reduced.

In general, the vortex tube has a cooling performance for supplying the cold air at a temperature that is less than the temperature of the supplied compressed air by about 50° C. when a pressure of the compressed air supplied from the compressor is about 0.7 MPa. In order to cool the sheet S after the fixing process, so as to prevent the adhesion of delivered sheets, the cold air 61 is only required to have a temperature in a range from about 5° C. to 10° C., and is not required to have a temperature that is less than the above-mentioned range. Therefore, even when the temperature of the compressed air 60 is 30° C., the cold air 61 having a temperature that is less than the temperature of the compressed air 60 by about 20° C. is only required to be extracted from the vortex tube 51. Therefore, a supply pressure from the compressor 50 is only required to be about 0.2 MPa. Hence, a small-size compressor can sufficiently fulfill the function as the compressor 50. According to this embodiment, the sheet S can be cooled with a small-size and low-cost configuration. Thus, occurrence of a harmful effect on the image when the image formation speed is increased to improve productivity can be suppressed.

A method of cooling the sheet S delivered from the fixing portion 45 with use of the cold air 61 supplied from the vortex tube 51 is not limited to the method of directly jetting the cooling blow 61*a*, which is an airflow having a low temperature, against the sheet S having a high temperature. For example, as illustrated in FIG. 4, a sheet delivery metallic roller 53 (cooling portion), which is capable of cooling the sheet S with use of the cooling air supplied from the vortex tube 51, may be provided between the fixing portion 45 and the delivery tray 13.

Figure 5:
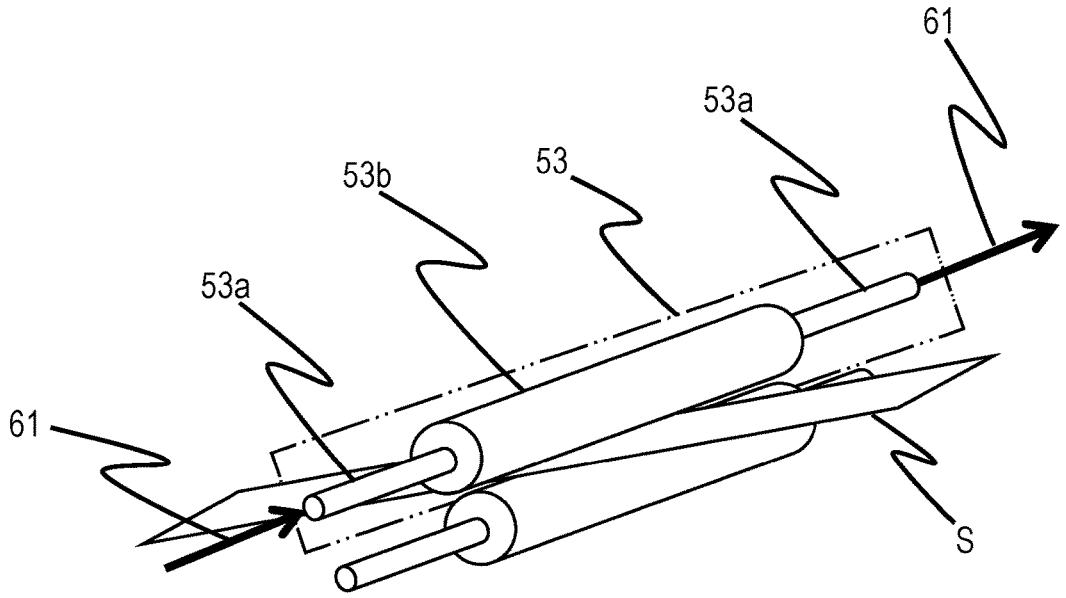
FIG. 5 is a view for illustrating an example of a sheet delivery roller having a cooling function.

The sheet delivery metallic roller 53 includes a hollow roller shaft 53*a* and a metal roller 53*b*, as illustrated in FIG. 5. The cold air 61 generated by the vortex tube 51 is supplied into the hollow roller shaft 53*a* to cool the metal roller 53*b* from inside. The sheet S, after the fixing process, is cooled by being brought into contact with the cooled metal roller 53*b*. Both of rollers of a roller pair, which interpose the sheet S there between, may be the sheet delivery metallic rollers 53. Further, only one roller of the roller pair may be the sheet delivery metallic roller 53, whereas a conveying roller having a large frictional force with the sheet S may be used as another roller of the roller pair.

Figure 4:
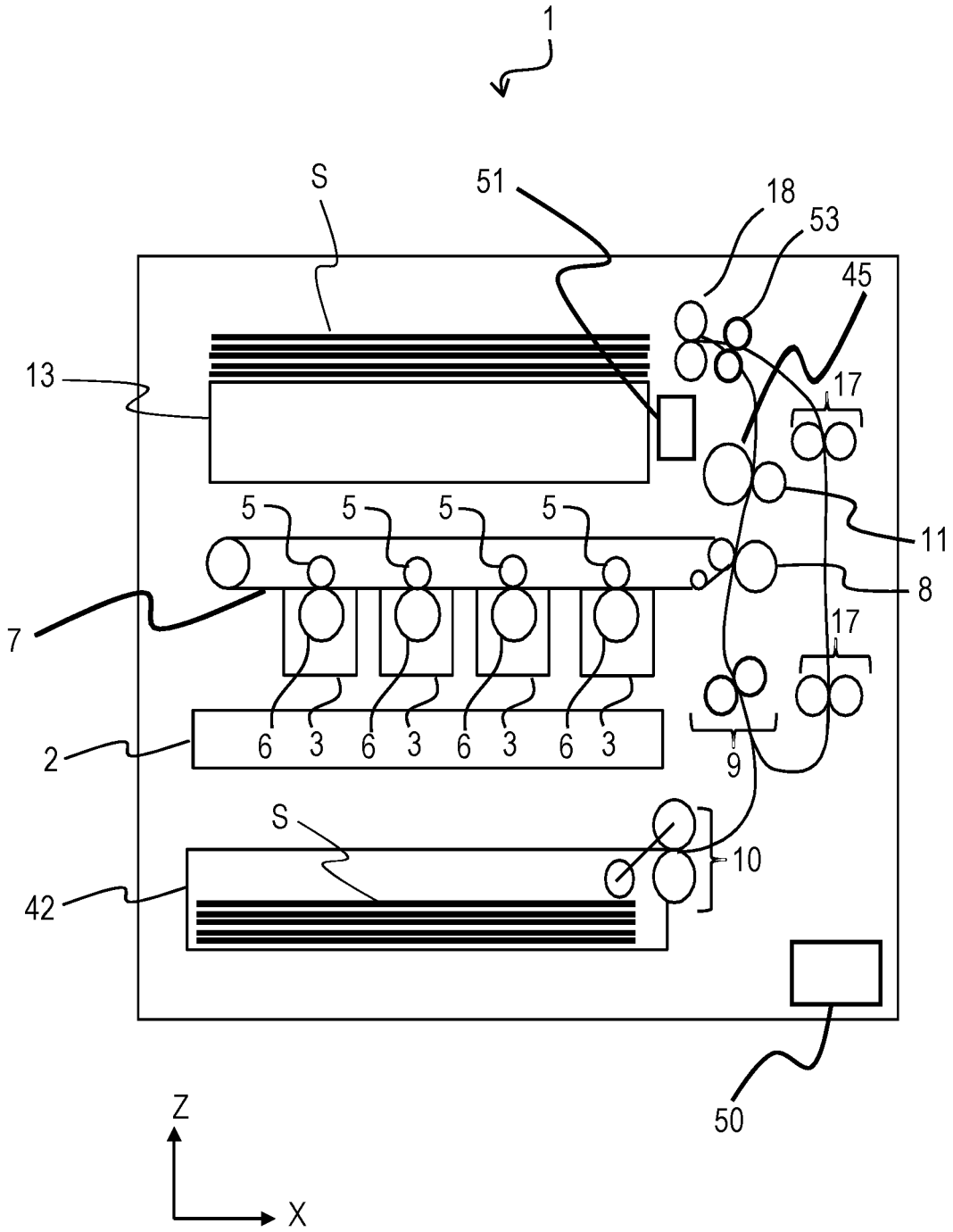
FIG. 4 is a sectional view of the image forming apparatus of another embodiment of the present invention.

In the image forming apparatus 1 illustrated in FIG. 4, the sheet delivery metallic roller 53 is additionally provided independently of the delivery conveyance portion 18 of the image forming apparatus 1 illustrated in FIG. 2. The roller of the delivery conveyance portion 18 illustrated in FIG. 2 may be replaced, however, by the sheet delivery metallic roller 53. In this case, an arrangement space for providing additional rollers is not required to be ensured. Hence, the image forming apparatus 1 is not increased in size, and cost is suppressed.

Figure 6:
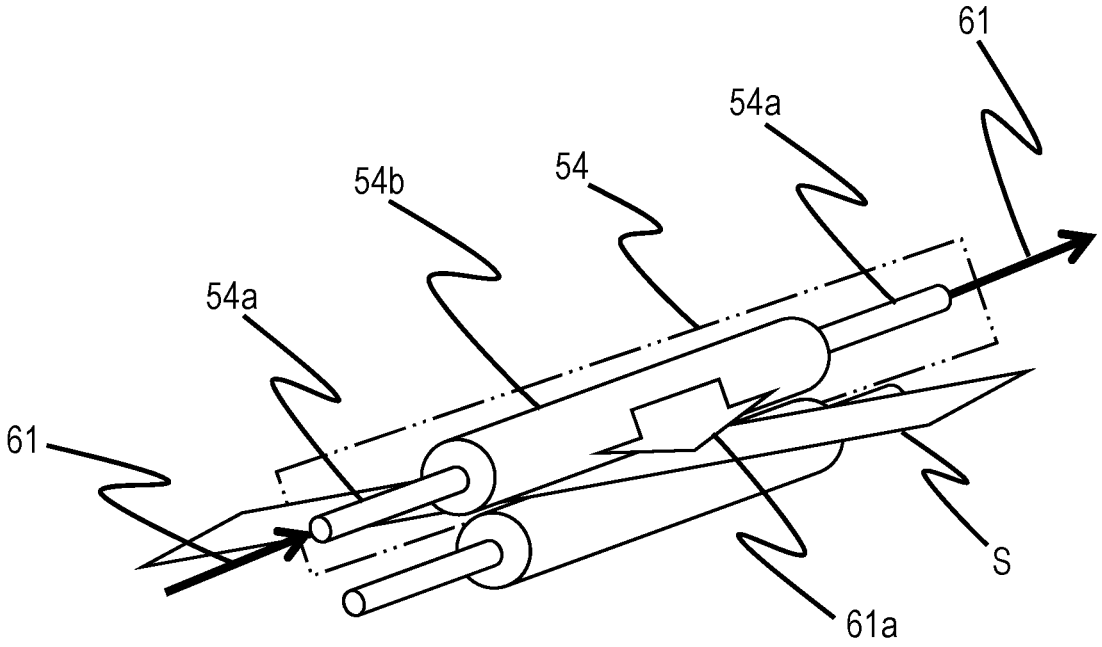
FIG. 6 is a view for illustrating another example of the sheet delivery roller having the cooling function.

As illustrated in FIG. 6, a sheet delivery sponge roller 54 (cooling portion) may be provided in place of the sheet delivery metallic roller 53. The sheet delivery sponge roller 54 includes a hollow roller shaft 54*a* and a sponge roller 54*b* made of sponge. The roller shaft 54*a* has an opening from which the cold air 61 is jetted. The cold air 61 supplied from the vortex tube 51 is caused to flow inside the roller shaft 54*a*. In this manner, the cooling blow 61*a* is discharged from the sponge roller 54*b*. According to this configuration, the sheet S, after the fixing process, can be cooled while a curl of the sheet S can be eliminated at a nip between the sponge roller 54*b* and a roller opposed thereto. The synergy of a curl reducing effect provided by the nip between the sponge roller 54*b* and the roller opposed thereto, and a curl reducing effect provided by the cooling blow 61*a* achieves extremely high curl reducing performance.

As exemplified above, the sheet S delivered from the fixing portion 45 is immediately cooled. In this manner, the toners can be firmly fixed onto the sheet S, and hence, the generation of an image defect due to the adhesion of delivered sheets S on the sheet S stacked in the delivery tray 13 can be prevented. The sheet S can be cooled with use of the cooling blow 61*a* or the roller 54 on both sides of the sheet S or on one side of the sheet S. In particular, it is effective to cool a side of a sheet surface onto which the toner images have been transferred.

Through immediate cooling of the sheet S delivered from the fixing portion 45, the amount of curl of the sheet S can be reduced. Therefore, problems in conveyance such as damage of the sheet S caused by the sheet S being caught on the sheet delivery guides 21, can be reduced.

Figure 7:
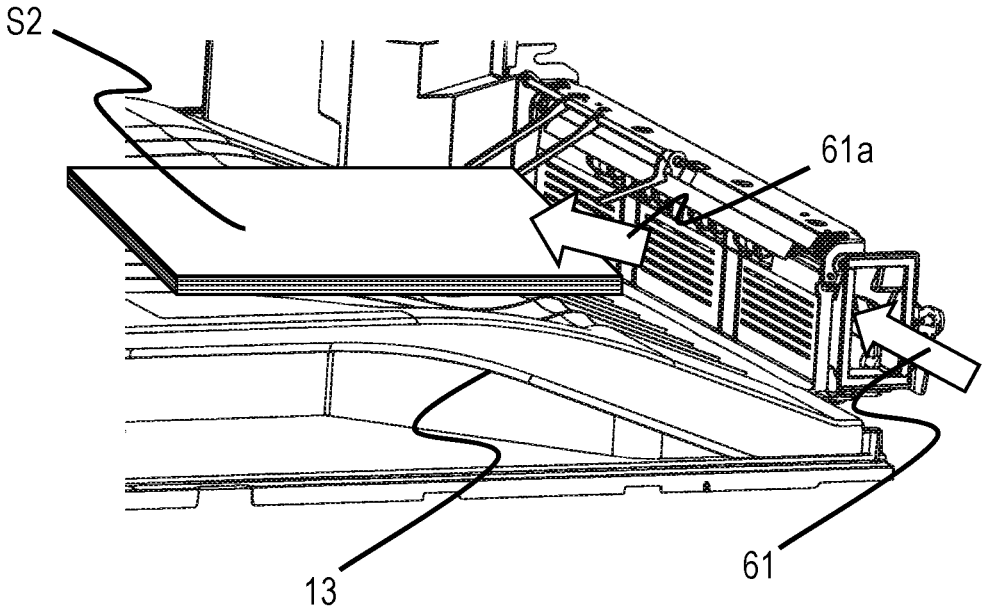
FIG. 7 is a view for illustrating an example of a sheet delivery tray having the cooling function.

The cold air 61 supplied from the vortex tube 51 may be supplied so that the cooling portion jets the cooling blow 61*a*, which is an airflow having a low temperature, against the sheet S delivered to the delivery tray 13 or a sheet bundle S2 being a stack of a plurality of the sheets S as illustrated in FIG. 7. In this manner, the stacked sheet bundle S2 is cooled, and hence, a harmful effect on the image due to the adhesion of delivered sheets can be further suppressed.

Heating and Dehumidifying Mechanism

When an image forming operation is performed in a cold state inside the casing of the image forming apparatus 1, dew condensation occurs on the conveyance guides 21 provided in a conveyance passage for the sheet S, causing water drops to adhere to the sheet S, and, therefore, causing a harmful effect on the image in some cases.

In the image forming apparatus 1 of this embodiment, as illustrated in FIG. 3, the compressed air 60 generated by the compressor 50 is supplied to the vortex tube 51, thereby outputting the warm air 62 from the vortex tube 51. Then, the warm air 62 output from the vortex tube 51 is supplied to the sheet delivery guides 21 provided in the delivery passage for the sheet S after the fixing process. Through heating of the sheet delivery guides 21 from inside, the dew condensation on a paper passage surface of each of the sheet delivery guides 21 is prevented. Shapes of the sheet delivery guides 21 are not limited to those of an example illustrated in FIG. 3 as long as the sheet delivery guides 21 function as the conveyance guides for the sheet S after the fixing process.

It is suitable that timing to heat the sheet delivery guides 21 be before start of the image forming operation. This is because, when the sheet delivery guides 21 are sufficiently heated before the fixing portion 45 starts a heating operation, it is highly effective. In view of this fact, a unit configured to monitor a temperature inside the casing of the image forming apparatus 1 may be provided so as to control an operation of the compressor 50 and a supply passage for the warm air 62 in accordance with the temperature inside the casing of the image forming apparatus 1. Specifically, when a temperature state at 22° C. or less in which the dew condensation is liable to occur is detected, the operation of the compressor 50 and the supply passage for the warm air 62 are controlled so that the warm air 62 is actively supplied to the sheet delivery guides 21.

When a humidity of the sheets stored in the sheet feeding section 42 of the image forming apparatus 1 increases, the sheet is liable to be curled after the image is fixed thereon by the fixing portion 45, and hence a paper jam is liable to occur. In the image forming apparatus 1 of this embodiment, the warm air 62 discharged from the vortex tube 51 is supplied to the sheet feeding section 42, which is the recording medium feeding section.

Figure 8:
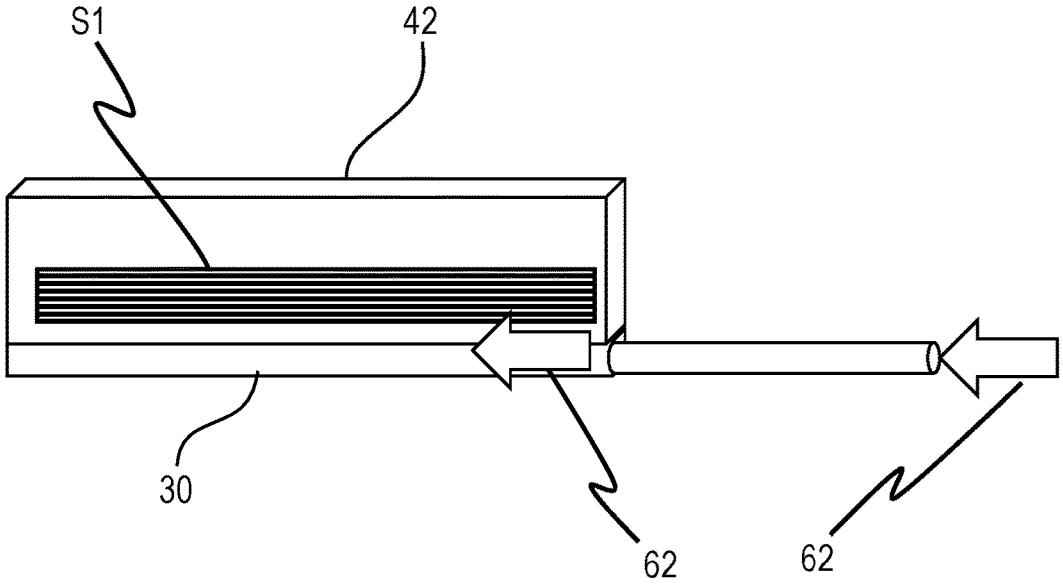
FIG. 8 is a view for illustrating an example of a sheet storage section having a heating (dehumidifying) function.

In FIG. 8, a specific example of heating of the sheet feeding section 42 with the warm air 62 is illustrated. The warm air 62 supplied from the vortex tube 51 is supplied to a lower part of the sheet feeding section 42 to heat stored sheets S1, thereby suppressing moisture absorption of the sheets S1. In the image forming apparatus 1 of this embodiment, the compressed air 60 is supplied to the vortex tube 51 so as to cool the sheet S after the fixing process during the image forming operation. During the supply of the compressed air 60, the sheet feeding section 42 can be dehumidified with use of the warm air 62 output from the vortex tube 51. As compared to a case in which the sheet feeding section 42 is heated by an electrical heater provided along the sheet feeding section 42, the generation of the curl of the sheet S can be suppressed with extremely high energy efficiency. For example, when it is assumed that the sheet feeding section 42 is dehumidified with the electrical heater, power at about 20 W is expected to be required. Meanwhile, according to this embodiment, power consumed in the compressor 50 can be reduced to 10 W or lower.

Another Embodiment

The embodiment of the present invention is not limited to the embodiment described above, and can be appropriately changed. For example, the configuration of the image forming apparatus 1 is not limited to that illustrated in FIG. 1. The image forming apparatus 1 is not required to be of a four-drum type, and is not required to use the intermediate transfer belt 7. Further, the recording medium onto which the image is fixed is not limited to the sheet or the paper.

The image forming apparatus 1 is only required to cool the high-temperature recording medium onto which the image has been fixed by heating with use of the cool air 61 from the vortex tube 51. Further, a portion that is liable to be adversely affected by a high humidity inside the image forming apparatus 1 is only required to be heated with use of the warm air 62 from the vortex tube 51. The embodiment described in one in which the compressor 50 is arranged inside the casing of the image forming apparatus 1. The image forming apparatus 1 may, however, receive the supply of the compressed air 60 from compressor 50 that is provided outside of the image forming apparatus 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming section configured to form a toner image;

a transfer portion configured to transfer the toner image, formed by the image forming section onto a recording medium;

a fixing portion configured to fix the toner image, which is transferred by the transfer portion, on the recording medium, by heating the toner image;

a vortex tube that is configured to receive a supply of compressed air generated by a compressor to generate cold air having a temperature that is less than a temperature of the compressed air, and warm air having a temperature that is greater than the temperature of the compressed air; and a cooling portion that is configured to receive a supply of the cold air generated by the vortex tube to cool the recording medium on which the toner image has been fixed by the fixing portion, wherein a member inside of the image forming apparatus is heated by the warm air generated by the vortex tube.

2. The image forming apparatus according to claim 1, further comprising a stacking section configured to stack the recording medium, onto which the toner image has been fixed by the fixing portion, thereon, wherein the cooling portion is configured to jet the cold air against the recording medium, while the recording medium onto which the toner image has been fixed by the fixing portion is conveyed from the fixing portion to the stacking section.

3. The image forming apparatus according to claim 1, further comprising a stacking section configured to stack the recording medium, onto which the toner image has been fixed by the fixing portion, thereon, wherein the cooling portion includes a roller cooled by the cold air, and the cooling portion is configured to bring the roller into contact with the recording medium, while the recording medium onto which the toner image has been fixed by the fixing portion, is conveyed from the fixing portion to the stacking section.

4. The image forming apparatus according to claim 1, further comprising a stacking section configured to stack the recording medium, onto which the toner image has been fixed by the fixing portion, thereon, wherein the cooling portion includes a sponge roller that rotates while jetting the cold air against the recording medium, and the cooling portion is configured to bring the sponge roller into contact with the recording medium while the recording medium, onto which the toner image has been fixed by the fixing portion, is conveyed from the fixing portion to the stacking section.

5. The image forming apparatus according to claim 1, further comprising a stacking section configured to stack the recording medium, onto which the toner image has been fixed by the fixing portion, thereon, wherein the cooling portion is configured to jet the cold air against the recording medium stacked on the stacking section.

6. The image forming apparatus according to claim 1, further comprising a conveyance guide configured to guide the recording medium, onto which the toner image has been fixed by the fixing portion, wherein the member to be heated by the warm air comprises the conveyance guide.

7. The image forming apparatus according to claim 1, further comprising a storage section configured to store a recording medium onto which an image is to be formed, wherein the member to be heated by the warm air comprises the recording medium stored in the storage section.

8. The image forming apparatus according to claim 1, further comprising the compressor configured to generate the compressed air.

9. An image forming apparatus comprising:

an image forming section configured to form a toner image;

a transfer portion configured to transfer the toner image, formed by the image forming section onto a recording medium;

a fixing portion configured to fix the toner image, which is transferred by the transfer portion, on the recording medium, by heating the toner image; and a vortex tube that is configured to receive a supply of compressed air generated by a compressor to generate cold air having a temperature that is less than a temperature of the compressed air and warm air having a temperature that is greater than the temperature of the compressed air, wherein a heat generating portion of the image forming apparatus is cooled by the cold air generated by the vortex tube, and an interior of the image forming apparatus is dehumidified by the warm air generated by the vortex tube.

10. The image forming apparatus according to claim 9, wherein the heat generating portion of the image forming apparatus, which is to be cooled by the cold air, comprises an electrical component.

11. The image forming apparatus according to claim 9, further comprising a storage section configured to store a recording medium onto which an image is to be formed, wherein the recording medium stored in the storage section is dehumidified by the warm air.

12. An image forming apparatus comprising:

an image forming section configured to form a toner image;

a transfer portion configured to transfer the toner image, formed by the image forming section, onto a recording medium;

a fixing portion configured to fix the toner image, which is transferred by the transfer portion, on the recording medium by heating the toner image; and a vortex tube that is configured to receive a supply of compressed air generated by a compressor to generate cold air having a temperature that is less than a temperature of the compressed air and warm air having a temperature that is greater than the temperature of the compressed air, wherein a heat generating portion of the image forming apparatus is cooled by the cold air generated by the vortex tube, and an interior of the image forming apparatus is heated by the warm air generated by the vortex tube.

13. The image forming apparatus according to claim 12, wherein the heat generating portion of the image forming apparatus, which is to be cooled by the cold air, comprises an electrical component.

14. The image forming apparatus according to claim 12, further comprising a conveyance guide configured to guide the recording medium, onto which the toner image has been fixed by the fixing portion, wherein the conveyance guide is heated by the warm air.

15. The image forming apparatus according to claim 12, further comprising a storage section configured to store a recording medium onto which an image is to be formed, wherein the recording medium stored in the storage section is heated by the warm air.

16. The image forming apparatus according to claim 12, further comprising the compressor configured to generate the compressed air.

* * * * *